US005081927A

United States Patent [19]

Jahn

[11] Patent Number: 5,081,927

[45] Date of Patent: Jan. 21, 1992

[54] ROTARY PRINTING PRESS WITH DEVICE FOR ENGAGING OR DISENGAGING A RUBBER-COVERED CYLINDER WITH AN IMPRESSION CYLINDER AND/OR A PLATE CYLINDER

[75] Inventor: Hans-Georg Jahn, Wiesenbach, Fed. Rep. of Germany

[73] Assignee: Heidelberger Druckmaschinen AG, Heidelberg, Fed. Rep. of Germany

[21] Appl. No.: 564,174

[22] Filed: Aug. 7, 1990

[30] Foreign Application Priority Data

Aug. 7, 1989 [DE] Fed. Rep. of Germany ..... 3926087

[51] Int. Cl.[5] ..... B41F 7/04; B41F 5/16

[52] U.S. Cl. ..... 101/218; 101/184; 101/247; 101/352

[58] Field of Search ..... 101/218, 247, 177, 352, 101/209, 284, 285, 182, 192, 185, 144, 145, 184

[56] References Cited

U.S. PATENT DOCUMENTS

| | | | |
|---|---|---|---|
| 2,773,445 | 12/1956 | Wood | 101/218 |
| 2,986,086 | 5/1961 | Siebke | 101/247 |
| 3,552,313 | 1/1971 | Jeschke | 101/218 |
| 3,584,578 | 6/1971 | Jurny . | |
| 4,423,678 | 1/1984 | Matsumoto | 101/248 |
| 4,458,591 | 7/1984 | Guaraldi | 101/247 |
| 4,488,484 | 12/1984 | Jiruse et al. . | |
| 4,503,771 | 3/1985 | Herzel et al. | 101/247 |
| 4,598,640 | 7/1986 | Nawrath | 101/177 |

FOREIGN PATENT DOCUMENTS

| | | | |
|---|---|---|---|
| 1176673 | 8/1964 | Fed. Rep. of Germany . | |
| 7125259 | 7/1971 | Fed. Rep. of Germany . | |
| 2153690 | 12/1974 | Fed. Rep. of Germany . | |
| 3318316 | 5/1983 | Fed. Rep. of Germany | 101/218 |
| 3412812 | 6/1985 | Fed. Rep. of Germany . | |
| 2507961 | 12/1982 | France . | |
| 221748 | 7/1968 | Sweden | 101/218 |
| 1118197 | 6/1968 | United Kingdom | 101/218 |
| 1249004 | 10/1971 | United Kingdom . | |

*Primary Examiner*—J. Reed Fisher
*Assistant Examiner*—E. P. Raciti
*Attorney, Agent, or Firm*—Herbert L. Lerner; Laurence A. Greenberg

[57] ABSTRACT

In a rotary printing press, there is provided a device for bringing a rubber-covered cylinder into and out of engagement with at least one of a pair of cylinders consisting of an impression cylinder and a plate cylinder, the rubber-covered cylinder being mounted on a shaft, which includes a substantially circular ring turnably disposed on the shaft of the rubber-covered cylinder, the ring being spring biased in a direction towards a middle location between two circumferentially rounded bracing stops and being formed with an indentation at a section of the circumference thereof, the ring being turnable on the shaft so as to move the indented section of the circumference thereof into a position opposite one of the bracing stops for bringing the rubber-covered cylinder out of engagement with the impression cylinder, the indented section being formed as an insert channel for accommodating therein the circumferentially rounded one bracing stop, the other of the pair of bracing stops being in continual engagement with the circular circumference of the ring and being displaceable by remote control for disengaging the rubber-covered cylinder from the plate cylinder without turning the ring, the other biasing stop also forming a support location for introducing the circumferentially rounded one bracing stop into the insert channel in an operating phase wherein the rubber-covered cylinder is disengaged from the impression cylinder, as well as in an operating phase wherein the rubber-covered cylinder is disengaged from both the impression cylinder and the plate cylinder.

2 Claims, 5 Drawing Sheets

ROTARY PRINTING PRESS WITH DEVICE FOR ENGAGING OR DISENGAGING A RUBBER-COVERED CYLINDER WITH AN IMPRESSION CYLINDER AND/OR A PLATE CYLINDER

The invention relates to a device in a rotary printing machine for bringing a rubber-covered cylinder into and out of engagement with at least one of a pair of cylinders consisting of an impression cylinder and a plate cylinder, the rubber-covered cylinder being mounted on a shaft.

In conventional constructions of this general type (U.S. Pat. No. 3,552,313), circumferential sections which are indented from a circularly shaped ring mounted coaxially with the rubber-covered cylinder, for example, are formed as flats, each of which is assigned to a counterpressure roller. When the ring is turned so that a first flat is in a position opposite a first counterpressure roller, the rubber-covered cylinder is lifted off the impression cylinder as a result of spring loading or bias; as the ring is turned farther so that a second flat comes into a position opposite a second counterpressure roller, the rubber-covered cylinder is lifted off the plate cylinder. The corresponding disengagement positions of the rubber-covered cylinder have limited stability, which is disadvantageous particularly in the case of high-speed presses. For this reason in particular, the corresponding counterpressure rollers are, in turn, also adjustable in that they are seated on eccentric shafts which are movable by threaded spindles. This adjustability of the counterpressure rollers serves only for accurately determining the respective positions of the rubber-covered cylinder when it is engaged with and disengaged from the other two cylinders. It has nothing to do with the engagement and disengagement motion during its use. A further disadvantage of the heretofore known constructions is that, in order to disengage the rubber-covered cylinder from the plate cylinder, it is basically necessary, first of all, to pass through the disengagement travel which removes or separates the rubber-covered cylinder from the impression cylinder.

It is accordingly an object of the invention to provide a rotary printing press with a device of the foregoing general type having a mechanical construction for effecting engagement and disengagement motions which is more advantageous with regard to expense of manufacture and is also more favorable with regard to the operation thereof, which permits, in particular, considerably greater precision in the construction of the device and in the engagement and disengagement motions.

With the foregoing and other objects in view, there is provided, in accordance with the invention, in a rotary printing press, a device for bringing a rubber-covered cylinder into and out of engagement with at least one of a pair of cylinders consisting of an impression cylinder and a plate cylinder, the rubber-covered cylinder being mounted on a shaft, comprising a substantially circular ring turnably disposed on the shaft of the rubber-covered cylinder, the ring being spring-biased in a direction towards a middle location between two circumferentially rounded bracing stops and being formed with an indentation at a section of the circumference thereof, the ring being turnable on the shaft so as to move the indented section of the circumference thereof into a position opposite one of the bracing stops for bringing the rubber-covered cylinder out of engagement with the impression cylinder, the indented section being formed as an insert channel for accommodating therein the circumferentially rounded one bracing stop, the other of the pair of bracing stops being in continual engagement with the circular circumference of the ring and being displaceable by remote control for disengaging the rubber-covered cylinder from the plate cylinder without turning the ring, the other biasing stop also forming a support location for introducing the circumferentially rounded one bracing stop into the insert channel in an operating phase wherein the rubber-covered cylinder is disengaged from the impression cylinder, as well as in an operating phase wherein the rubber-covered cylinder is disengaged from both the impression cylinder and the plate cylinder.

In accordance with a concomitant feature of the invention, the displaceable other bracing stop is seated on one arm of a fixed bellcrank, the bellcrank having another arm engaged by a piston, the piston being a double-entry piston with pressure-medium being applicable to opposite sides thereof.

This construction according to the invention results in a rotary printing press with a lacquering and printing-plate unit, respectively, having an engagement and disengagement device which can be made with highly precise construction an, thus, also with highly precise engagement and disengagement motions thereof. This is of particular significance with regard to high-speed rotary printing presses. The advantages are also of considerable importance with respect to lacquering units of rotary printing presses. To effect a disengagement from the impression cylinder, the ring is turned so that one of the support or bracing stops is able to enter into an indentation or insert channel.

The entry of the stop into the indentation is caused by the spring loading or bias, in conjunction with the bracing, which may possibly even be adjustable from the other bracing or support stop. When the latter bracing or support stop is then displaced, a disengagement motion away from the plate cylinder occurs. If the indentation or insert channel remains in operation with the appertaining support or bracing stop, and the other bracing or support stop is displaced, a disengagement away from the impression cylinder and from the plate cylinder occurs as a result of the spring loading or bias.

All disengagement motions are centrally directed to the greatest extent, particularly, the disengagement motion with respect to the impression cylinder. Each of the disengagement motions can be initiated independently of the other by the machine operator. Use is made of the existing disengagement stop for this purpose. It has been found that it is unnecessary to apply any free travel or take-up slack into the control means in order to rotate the ring; although the ring turns slightly when the bracing or support stop is displaced, this has no effect, because the other support stop is able to lie at an adequate spacing in front of the (sharp) transition point between the circular circumference of the ring and the insert channel.

Other features which are considered as characteristic for the invention are set forth in the appended claims.

Although the invention is illustrated and described herein as embodied in a rotary printing press with device for engaging a rubber-covered cylinder with and disengaging it from an impression cylinder and/or a plate cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
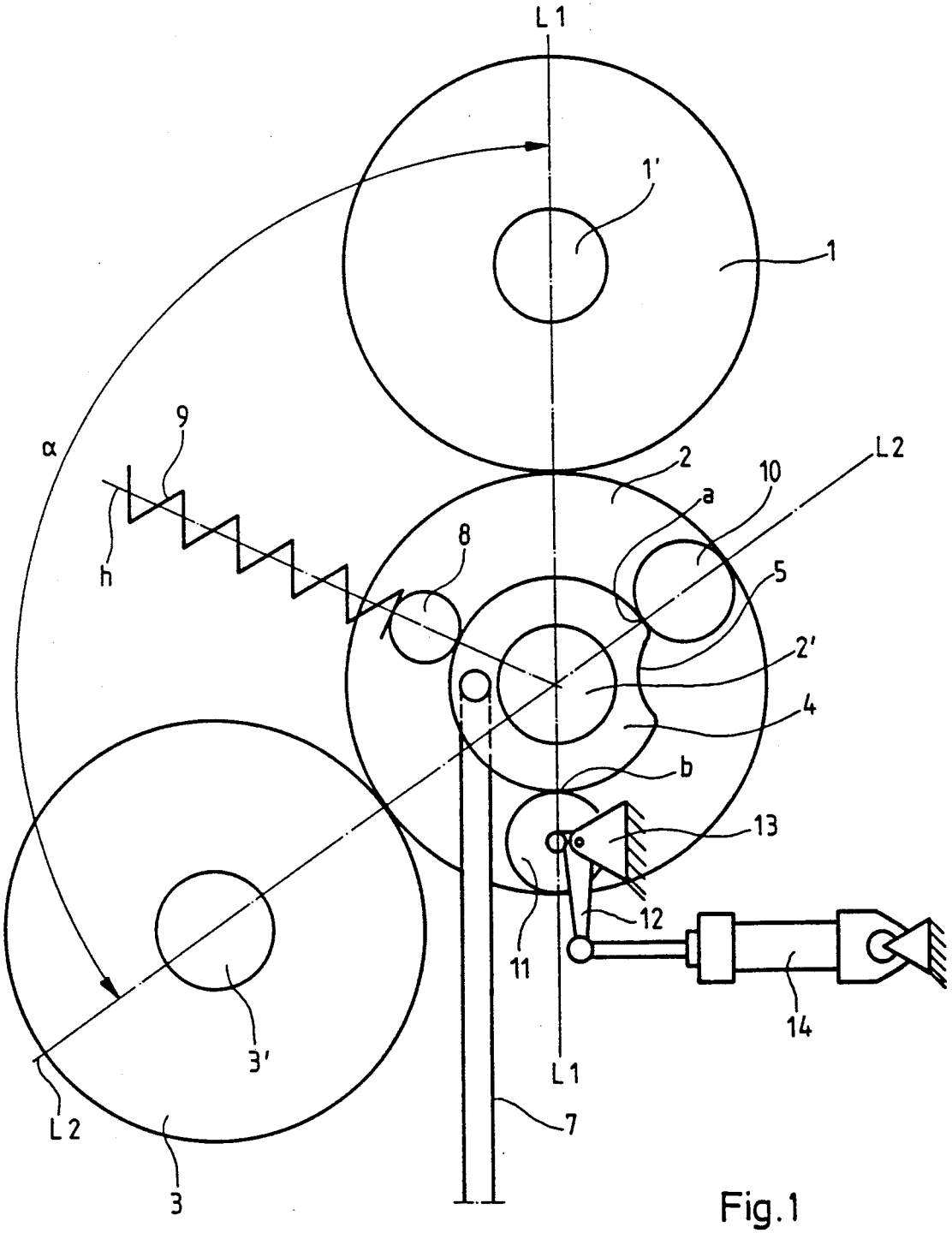
FIG. 1 is a diagrammatic side elevational view of an arrangement of three cylinders, including a rubber-covered cylinder in contact with two adjacent cylinders.
Figure 4:
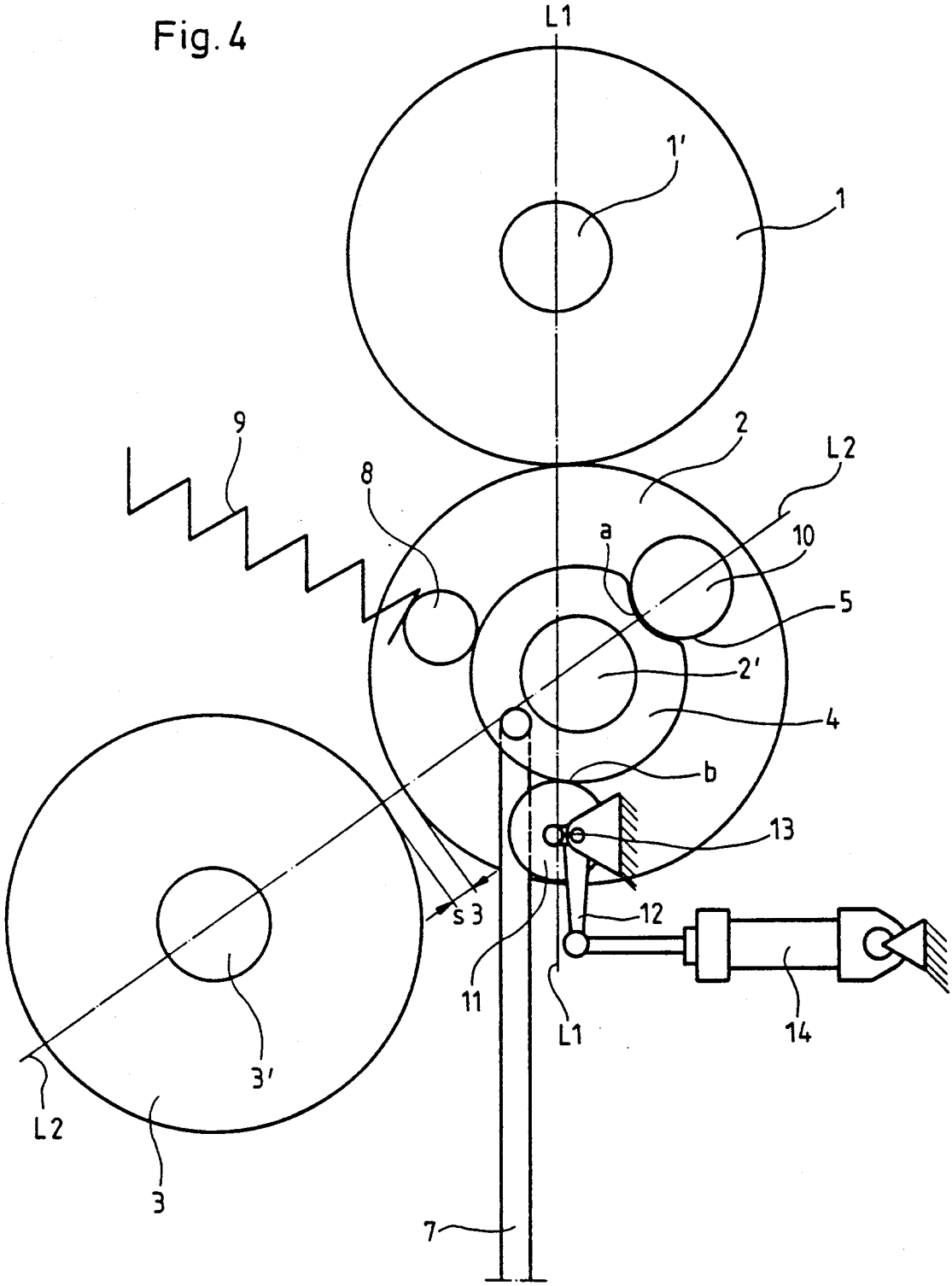
Figure 5:
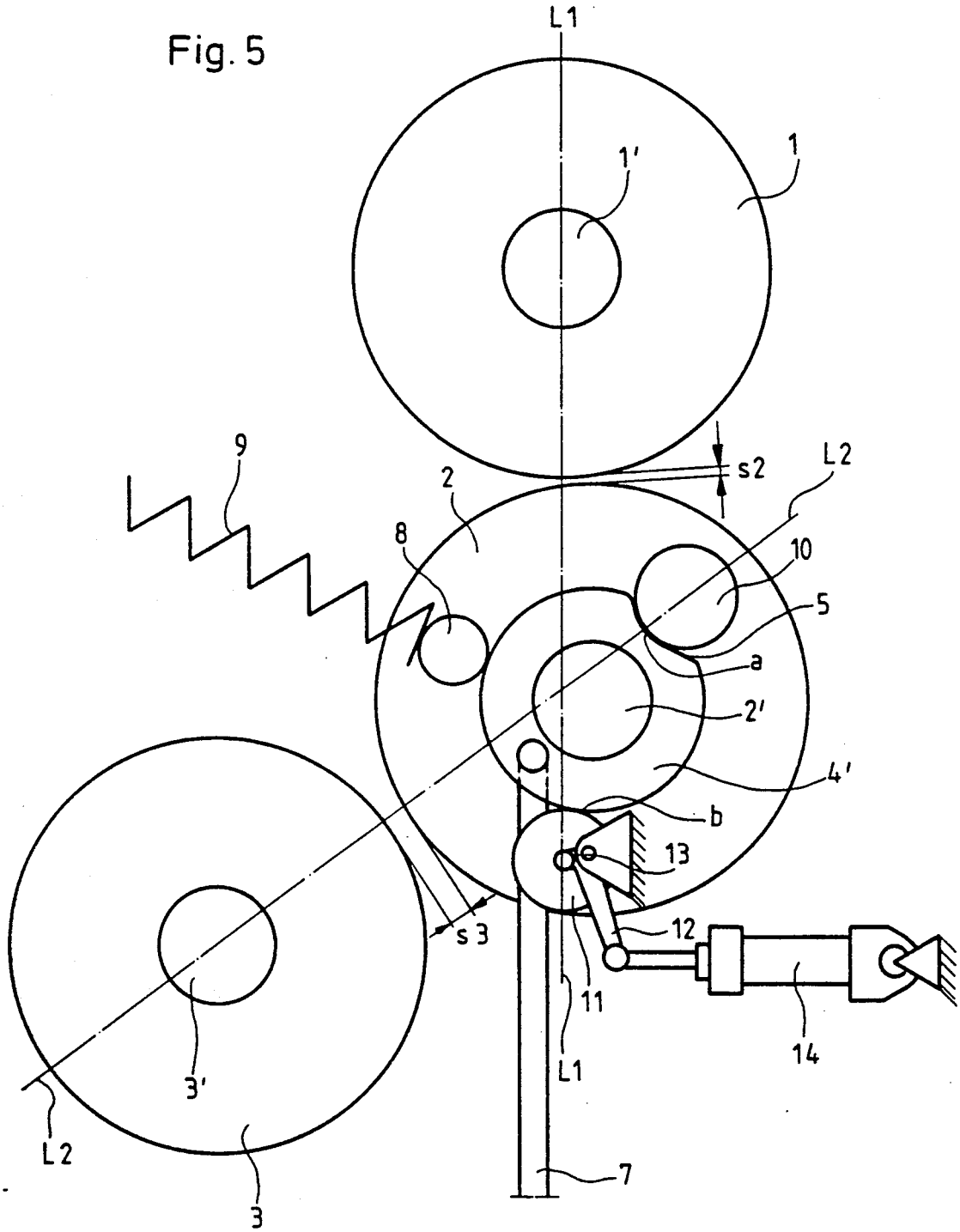

FIG. 4 is also a view like that of FIG. 1 wherein the rubber-covered cylinder is disengaged from the impression cylinder in a further operating phase of the device according to the invention; and FIG. 5 is a final view like that of FIG. 1 wherein the rubber-covered cylinder is disengaged from both the impression cylinder and the plate cylinder in an additional operating phase of the device according to the invention.

Referring now to the drawing and, first, particularly to FIG. 1 thereof, there is shown therein, not in the entirety thereof, an offset rotary printing press which includes a plate cylinder 1, a rubber-covered or blanket cylinder 2 and an impression cylinder 3. Assigned to the plate cylinder 1, in a conventional manner, are an inking unit and a dampening unit, not shown in detail. The three cylinders 1, 2 and 3, respectively have shafts 1', 2' and 3'. If the press is in operation with a lacquering unit, the dampening unit is omitted.

A ring 4 is assigned to the shaft 2' of the rubber-covered cylinder 2, and is turnably mounted thereon. The ring 4 is formed with an insert channel 5 and is turnable by means of a control rod 7. A roller 8, which is under the loading of a spring 9, is supported on the circumferential surface of the ring 4. The direction of application of the spring force lies approximately on a bisector h of an angle $\alpha$ included between planes in which the three shafts 1', 2' and 3' are disposed. The roller 8 may also be in the form of a cylinder.

Bracing or support stops 10 and 11 are assigned to the ring 4. The support stop 10, fixed with respect to the cylinder 2 and ring 4, cooperates with the insert channel 5 and has a circumference matching the latter.

The other support stop 11, likewise preferably again in the form of a roller, cooperates with the continuous outer circumferential surface of the ring 4 and is, in turn, engageable and disengageable approximately on a straight connecting line L1-L1 extending between the shaft 1' and the shaft 2', by being disposed on one arm of a lever or bellcrank 12, which is mounted in a fixed shoe 13 and is swivellable by means of a pneumatic cylinder 14 having a piston 14' therein which engages another arm of the bellcrank 12. The cylinder 14 is of the type having a double entry piston with pressure medium being applicable to opposite sides thereof.

Figure 2:
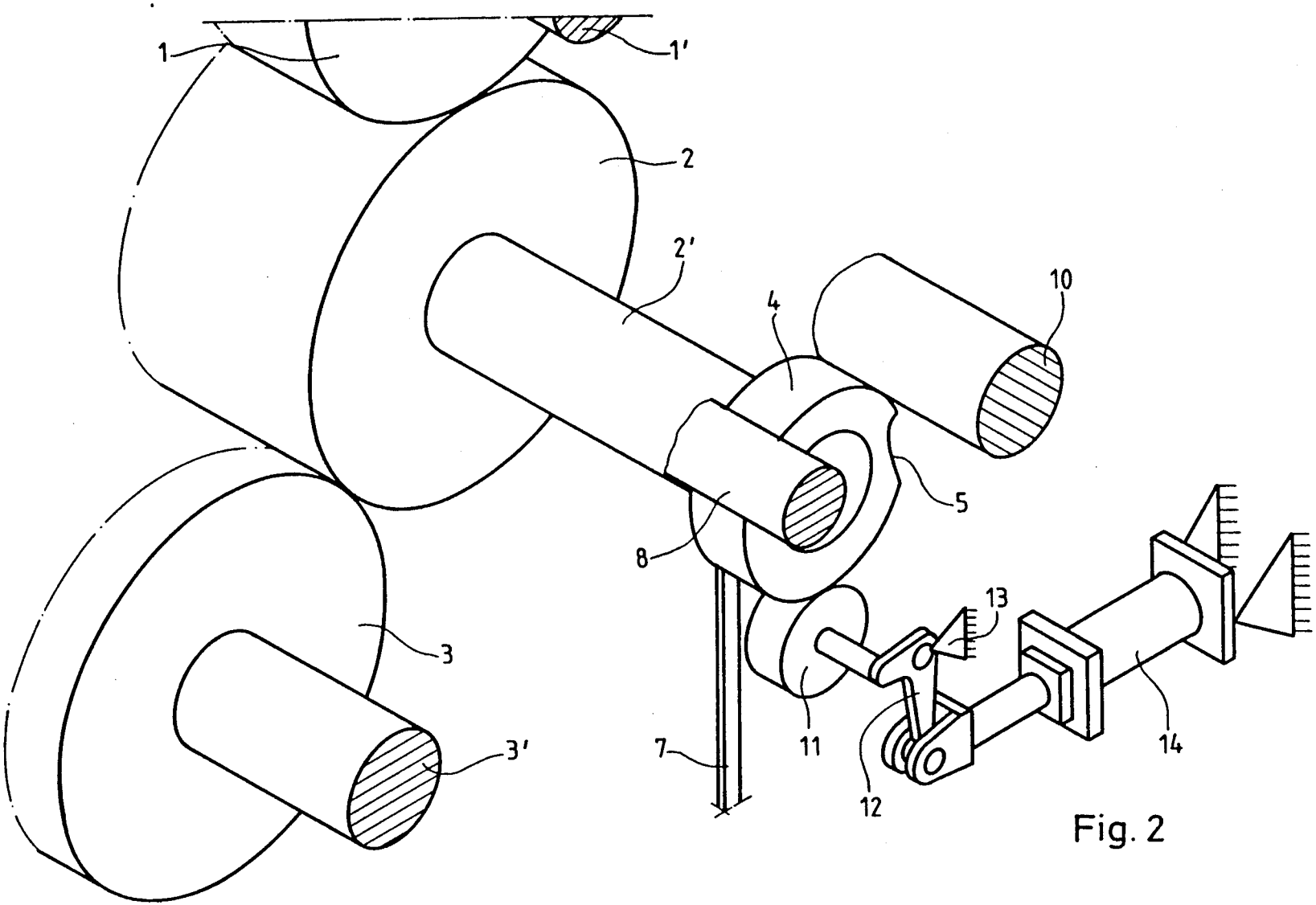
FIG. 2 is a perspective view of FIG. 1.

The same device, as shown in FIG. 2, is located in, mirror-image form at the opposite end of the shaft 2' of the rubber-covered cylinder 2, and is synchronously controlled.

Figure 3:
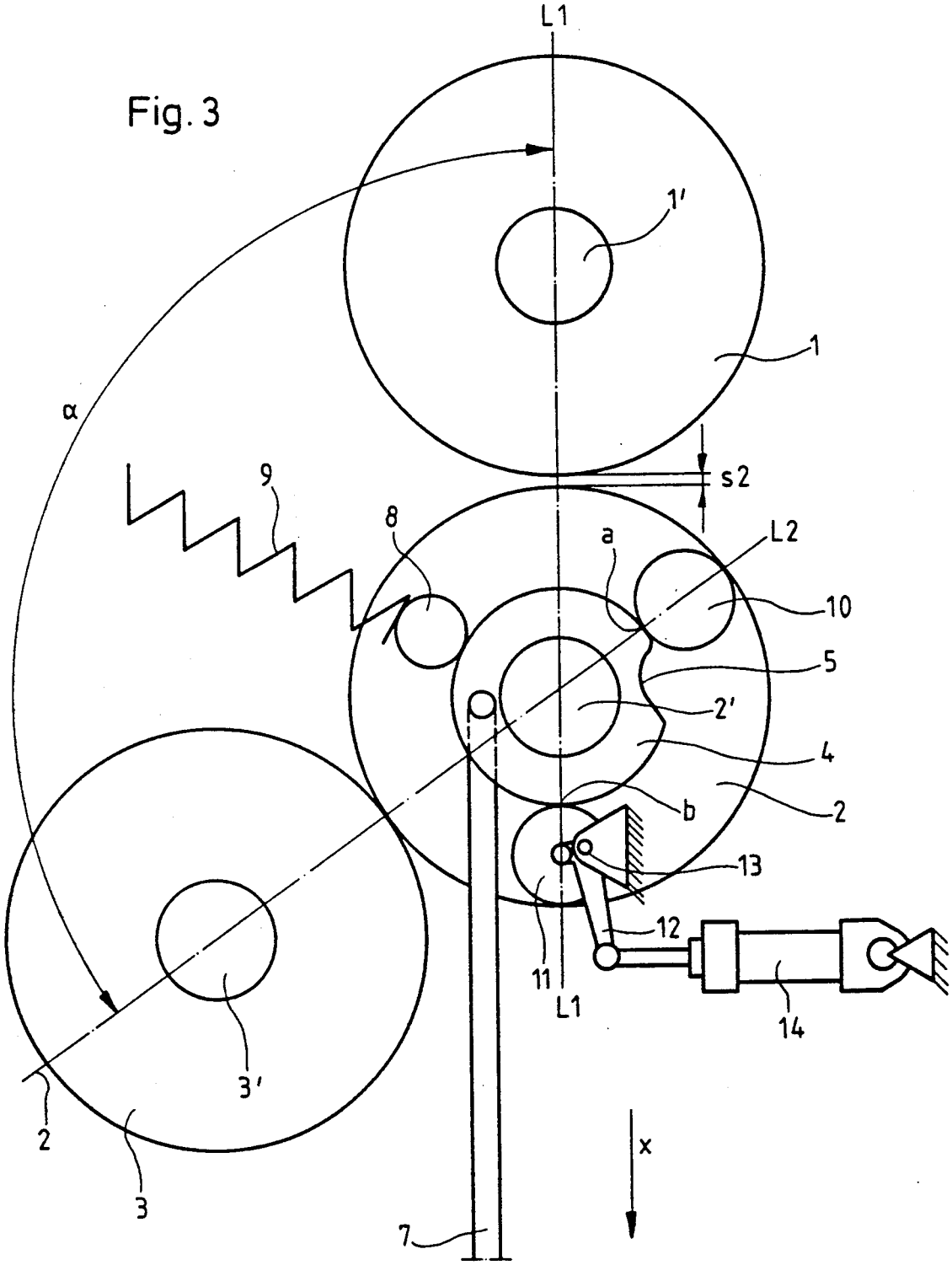
FIG. 3 is a view like that of FIG. 1 wherein the rubber-covered cylinder is disengaged from the plate cylinder in another operating phase of the device according to the invention.

If the stop 11 is displaced in the direction of the arrow x (FIG. 3) by the actuation of the pneumatic cylinder 14, it also being possible to categorize the displacement more or less as a rectilinear displacement of a point b (at any rate as far as the thus obtained displacement of the shaft 2' is concerned), the rubber-covered cylinder 2 then disengages from the plate cylinder 1 with the formation of a respective gap s2 therebetween. Subsequent turning of the ring 4 by the actuation of the control rod 7 until the operating phase shown in FIG. 5 is reached results in entry of the stop 10 into the insert channel 5. The force of the spring 9 displaces the shaft 2' of the rubber-covered cylinder 2 in such a manner that there is also a disengagement motion with respect to the impression cylinder 3, a gap s3 being formed between both cylinders 2 and 3.

Starting from the position shown in FIG. 1 and while maintaining the position of the stop 11, if only the ring 4 is initially turned to the position thereof shown in FIG. 4 by actuation of the control rod 7, the rubber-covered cylinder 2 remains in engagement with the plate cylinder 1, and only a disengagement motion of the rubber-covered cylinder 2 with respect to the impression cylinder 3 results, with the formation of a gap s3.

The foregoing is a description corresponding in substance to German Application P 39 26 087.9, dated Aug. 7, 1989, the International priority of which is being claimed for the instant application, and which is hereby made part of this application.

I claim:

1. In a rotary printing press having a pair of cylinders consisting of an impression cylinder and a plate cylinder, and a rubber-covered cylinder adjacent the pair of cylinders, a device for bringing the rubber-covered cylinder into and out of engagement with at least one of the pair of cylinders, the rubber-covered cylinder being mounted on a shaft, comprising a substantially circular ring turnably disposed on the shaft of the rubber-covered cylinder, two circumferentially rounded bracing stops disposed adjacent said ring, said bracing stops being spaced from one another with a middle location therebetween, said ring being spring-biased in a direction towards the middle location between said two circumferentially rounded bracing stops and being formed with an indentation at a section of the circumference thereof, said ring being turnable on the shaft so as to move said section of said circumference thereof formed with said indentation into a position opposite one of said bracing stops for bringing the rubber-covered cylinder out of engagement with the impression cylinder, said section formed with said indentation being formed as an insert channel for accommodating therein one of said pair of circumferentially rounded bracing stops, the other of said pair of bracing stops being in continual engagement with the circular circumference of said ring and being displaceable by remote control for disengaging the rubber-covered cylinder from the plate cylinder without turning said ring, said other bracing stop also forming a support location for introducing the circumferentially rounded one bracing stop into said insert channel in an operating phase wherein the rubber-covered cylinder is disengaged from the impression cylinder, as well as in an operating phase wherein the rubber-covered cylinder is disengaged from both the impression cylinder and the plate cylinder.

2. Device according to claim 1, further comprising a bellcrank having a first and a second arm, a double-entry piston actuable in both directions connected to said first arm, and said other of said pair of bracing stops connected to said second arm.

* * * * *